US010573269B2

(12) United States Patent
Wang et al.

(10) Patent No.: US 10,573,269 B2
(45) Date of Patent: Feb. 25, 2020

(54) DATA TRANSMISSION METHOD AND ELECTRONIC DEVICE

(71) Applicants: LENOVO (BEIJING) LIMITED, Beijing (CN); BEIJING LENOVO SOFTWARE LTD., Beijing (CN)

(72) Inventors: Pei Wang, Beijing (CN); Wei Zhang, Beijing (CN); Zhifeng Yang, Beijing (CN); Wenlin Hou, Beijing (CN); Yanlin Zhu, Beijing (CN); Daye Yang, Beijing (CN)

(73) Assignees: BEIJING LENOVO SOFTWARE LTD., Beijing (CN); LENOVO (BEIJING) LIMITED, Beijing (CN)

( * ) Notice: Subject to any disclaimer, the term of this patent is extended or adjusted under 35 U.S.C. 154(b) by 0 days.

(21) Appl. No.: 14/342,909

(22) PCT Filed: Oct. 18, 2012

(86) PCT No.: PCT/CN2012/083145

§ 371 (c)(1),
(2) Date: Mar. 5, 2014

(87) PCT Pub. No.: WO2013/064018

PCT Pub. Date: May 10, 2013

(65) Prior Publication Data

US 2014/0210832 A1 Jul. 31, 2014

(30) Foreign Application Priority Data

Oct. 31, 2011 (CN) ..... 2011 1 0338019

(51) Int. Cl.
*G09G 5/00* (2006.01)

(52) U.S. Cl.
CPC ..... *G09G 5/003* (2013.01); *G09G 5/006* (2013.01); *G09G 2330/021* (2013.01);
(Continued)

(58) Field of Classification Search
CPC ..... G09G 5/00; G09G 5/003; G09G 5/006; G09G 2330/021; G09G 2330/022;
(Continued)

(56) References Cited

U.S. PATENT DOCUMENTS 7,062,250 B1 * 6/2006 Kosaka ..... H04N 7/142 320/114
8,660,617 B1 2/2014 Banerjea et al.
(Continued)

FOREIGN PATENT DOCUMENTS

CN 1925655 A 3/2007
CN 101472131 A 7/2009
(Continued)

OTHER PUBLICATIONS

ComputerDictionary.pdf MicroSoft Press Computer Dictionary, 2nd Edition, ISBN 1-55615-597-2, published 1994.*
(Continued)

*Primary Examiner* — Wing H Chow
(74) *Attorney, Agent, or Firm* — Scully Scott Murphy & Presser

(57) ABSTRACT

A data transmission method and an electronic device are provided. A first electronic device having a display unit and a second electronic device having a processing unit communicate with each other wirelessly. The first electronic device receives data from the second electronic device for displaying on the display unit. The display unit of the first electronic device displays at a first display frame rate data transmitted from the second electronic device in a first mode. The first electronic device transmits, upon detecting a first trigger event, information associated with the first trigger event to the second electronic device. The first electronic device receives and displays data transmitted from the second electronic device in a second mode. The
(Continued)

electronic devices can be automatically switched between the two display frame rates and the two modes in response to the first trigger event.

12 Claims, 6 Drawing Sheets

(52) U.S. Cl.
CPC ..... *G09G 2330/022* (2013.01); *G09G 2340/0435* (2013.01); *G09G 2350/00* (2013.01); *G09G 2352/00* (2013.01); *G09G 2370/16* (2013.01)

(58) Field of Classification Search
CPC ..... G09G 2340/0435; G09G 2350/00; G09G 2352/00; G09G 2370/16; H04N 7/01
See application file for complete search history.

(56) References Cited

U.S. PATENT DOCUMENTS

| | | | | |
|---|---|---|---|---|
| 8,750,244 | B2 | 6/2014 | Oguchi | |
| 9,037,195 | B2 | 5/2015 | Banerjea et al. | |
| 2007/0049239 | A1 | 3/2007 | Joung et al. | |
| 2008/0094419 | A1 | 4/2008 | Leigh et al. | |
| 2009/0310618 | A1 | 12/2009 | Carter | |
| 2010/0091186 | A1* | 4/2010 | Takata | G09G 5/00 348/452 |
| 2011/0019725 | A1* | 1/2011 | Keller | H04L 5/0042 375/222 |
| 2011/0064048 | A1 | 3/2011 | Oguchi | |
| 2011/0098019 | A1* | 4/2011 | Fujii | H04M 1/576 455/411 |
| 2011/0261213 | A1* | 10/2011 | Rottler | G06F 3/04883 348/211.6 |
| 2012/0154507 | A1* | 6/2012 | Lyu | H04N 7/147 348/14.02 |
| 2012/0169835 | A1* | 7/2012 | Woo | H04L 12/1827 348/14.09 |
| 2014/0169250 | A1 | 6/2014 | Banerjea et al. | |

FOREIGN PATENT DOCUMENTS

| | | | |
|---|---|---|---|
| CN | 101661712 | A | 3/2010 |
| CN | 102026340 | A | 4/2011 |
| TW | 200709590 | A | 7/1994 |
| WO | WO 2007/092644 | A2 | 8/2007 |
| WO | WO 2007/092644 | A3 | 8/2007 |

OTHER PUBLICATIONS

International Search Report dated Jan. 24, 2013 issued in PCT/CN2012/083145.

* cited by examiner

DATA TRANSMISSION METHOD AND ELECTRONIC DEVICE

TECHNICAL FIELD

The present invention relates to split-type computer technology, and more particularly, to a data transmission method and an electronic device.

BACKGROUND

A split-type computer includes typically a host, a keyboard and a panel having a display function. In a mode where the panel is used, a battery is adopted to supply power to a panel subsystem. The capacity of the battery in the panel is limited due to a super slim and light structural dimension and design of the panel. A wireless display function, as the most power consuming function in the panel, occupies 45% of overall power consumption of the panel. In order to provide a sufficiently long battery lifetime, it is required to manage and control the power consumption of the panel. It is necessary to reduce the power consumption of the wireless display function.

The existing wireless display techniques, such as UWB, WIFI, Wireless HDMI and WHDI, are all designed for high definition (720p/1080p) wireless projection applications. Because these techniques support pictures of high resolution (1920*1080) and high frame transmission rate (30 fps or 60 fps), the wireless transmission maintains at a high data rate (100 Mbps-3.5 Gbps), resulting in a high transmission/reception power consumption (~4.5 W@1080p/30 fps) in the wireless display function. Additionally, the existing wireless display techniques are designed for home high definition TV play applications. They operate in a real-time screen copy mode where a content currently displayed on the screen is captured and transmitted all the time without saving the power consumption. In a software-based compression, coding and transmission scheme in a WIFI display technique as an example, data compression is required, which increases a CPU load and significantly increases both a system power consumption at a transmitter and a decoding power consumption at a receiver and is thus undesirable for power-saving. Further, this technique has high requirements on system hardware at the transmitter (it requires at least a dual-core CPU at 1.6 GHz). The compression and decompression will cause a system latency of at least 100 ms and are not suitable for application scenarios having high real-time requirements (e.g., games). Although a high compression rate can reduce power consumption, it will result in a worse image quality and is thus not suitable for high definition applications. Without distinguishing usage scenarios and applications, it is not possible to effectively reduce the average power consumption during actual usage.

Further, in the prior art, buffers are incorporated at the transmitter and the receiver, which increases hardware costs. In the high definition display techniques, it is required to support high data rates. When there are many frames to be effectively buffered and a capacity of 2 Mb is required for buffering one frame, a large buffer will be necessary. Multi-frame buffering tends to introduce a large latency in a game for example and is not suitable for scenarios having high real-time requirements. In most of the existing wireless display techniques, a dumping scheme is used where each received frame will be transmitted, without considering any power management.

Therefore, the following defect in the prior art haven been found. Because the existing wireless display function supports pictures of high definition and high frame transmission rate, the wireless transmission needs to maintain at a high data rate, resulting in high power consumption in data transmission and reception. The prior art fails to consider how to save the power consumption.

SUMMARY

The embodiments of the present invention provide a data transmission method and an electronic device, capable of addressing the defects in the prior art that, because the wireless display function supports pictures with high definition and high frame transmission rate, the wireless transmission needs to maintain at a high data rate, resulting in high power consumption in data transmission and reception.

According to an embodiment of the present invention, a data transmission method is provided. The method is applied in two electronic devices, of which a first electronic device has at least one display unit and a second electronic device has at least one processing unit. The first electronic device and the second electronic device communicate data with each other wirelessly. The first electronic device receives data transmitted from the second electronic device for displaying on the display unit. The method comprises steps of: displaying at a first display frame rate, by the display unit of the first electronic device, a data transmitted from the second electronic device in a first mode; transmitting upon detecting a first trigger event, by the first electronic device, information associated with the first trigger event to the second electronic device; receiving, by the first electronic device, a data transmitted from the second electronic device in a second mode; and displaying at a second display frame rate, by the display unit of the first electronic device, the data transmitted from the second electronic device in a second mode.

In a preferred embodiment, the first display frame rate is lower than the second display frame rate, compared with displaying the data at the second display frame rate the display unit has a lower power consumption when displaying the data at the first display frame rate, and the second electronic device has a lower power consumption in the first mode than that in the second mode.

In a preferred embodiment, the second electronic device has a data transceiver unit, and the data transceiver unit has a data transmission rate corresponding to the first display frame rate when the second electronic device is in the first mode, and the data transceiver unit has a data transmission rate corresponding to the second display frame rate when the second electronic device is in the second mode.

In a preferred embodiment, each frame has a frame length of 16 ms and comprises a downlink interval and an uplink interval, and the downlink interval occupies 95% of the frame length and the uplink interval occupies at least 5% of the frame length.

In a preferred embodiment, the first trigger event comprises a touch operation.

In a preferred embodiment, said transmitting, by the first electronic device upon detecting the first trigger event, the information associated with the first trigger event to the second electronic device comprises: notifying, when the first trigger event occurs before the uplink interval of a current frame, the second electronic device within the uplink interval of the current frame; and notifying, when the first trigger event occurs during the uplink interval of the current frame, the second electronic device within the uplink interval of a next frame subsequent to the current frame.

In a preferred embodiment, the first display frame rate is 16 fps or 15 fps and the second display frame rate is 64 fps or 60 fps.

In a preferred embodiment, said displaying at the first display frame rate, by the display unit of the first electronic device, the data transmitted from the second electronic device in the first mode comprises: configuring a predetermined number of frames as a period, each period containing four frames; reserving the downlink interval and the uplink interval in the first frame of the period and reserving only the uplink interval in the remaining frames of the period, or reserving the downlink interval and the uplink interval in the first frame of the period without reserving the downlink interval or the uplink interval in the remaining frames of the period.

In a preferred embodiment, the method further comprises: transmitting upon detecting a second trigger event, by the second electronic device, information associated with the second trigger event to the first electronic device; receiving, by the second electronic device, data transmitted from the first electronic device in the second mode; and processing, by the processing unit of the second electronic device, the data transmitted from the first electronic device in the second mode.

In a preferred embodiment, the second trigger event comprises at least one of a key pressing operation, a stream media play, a game event, a quick view of an image and a document operation.

According to another embodiment of the present invention, an electronic device is provided. The electronic device comprises: a data transceiver unit configured to communicate data with a second electronic device wirelessly, receive data transmitted from the second electronic device in a first mode and receive data transmitted from the second electronic device in a second mode; a display unit configured to display at a first display frame rate the data transmitted from the second electronic device in the first mode and display at a second display frame rate the data transmitted from the second electronic device in the second mode; and a detection unit configured to transmit, upon detecting a first trigger event, information associated with the first trigger event to the second electronic device.

In a preferred embodiment, the first display frame rate is lower than the second display frame rate, compared with displaying the data at the second display frame rate, the display unit has a lower power consumption when displaying the data at the first display frame rate, and the second electronic device has a lower power consumption in the first mode than that in the second mode.

In a preferred embodiment, the electronic device further comprises: a frame configuration unit configured to notify, when the first trigger event occurs before an uplink interval of a current frame, the second electronic device within the uplink interval of the current frame; and notifying, when the first trigger event occurs during the uplink interval of the current frame, the second electronic device within the uplink interval of a next frame subsequent to the current frame. Each frame has a frame length of 16 ms and comprises a downlink interval and an uplink interval.

With the embodiments of the present invention, the first electronic device supports both a first display frame rate and a second display frame rate. The second electronic device supports a first mode corresponding to the first display frame rate and a second mode corresponding to the second display frame rate. Because these two electronic devices can be automatically switched between the two display frame rates and the two modes in response to the first trigger event, when one of the first and second display frame rates has a lower power consumption than the other, the power consumptions of the first and second electronic devices can be reduced.

DETAILED DESCRIPTION OF THE EMBODIMENTS

In the following, the present invention will be described in detail with reference to the figures and the embodiments, such that the technical problem to be solved, technical solutions and advantages of the present invention will become more apparent.

Figure 1:
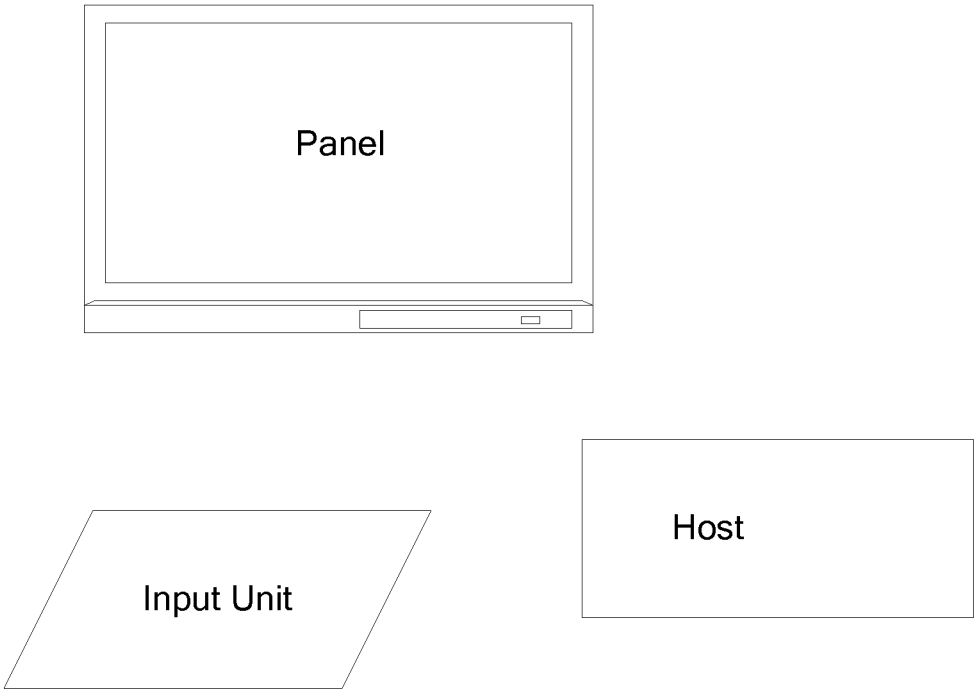
FIG. 1 is a schematic diagram showing a structure of a split-type computer according to an embodiment of the present invention.

As shown in FIG. 1, a split-type computer includes a host, an input unit and a panel having a display function. The host transmits data to be displayed to the panel using a wireless display function. A battery is adopted to supply power to the panel. The panel has a light structure and a slim dimension. In an embodiment of the present invention, an interrupt mechanism is initiated in response to a trigger event (e.g., a touch event) to switch from the current periodical transmission of the data to be displayed to a data transmission between the host and the panel as controlled by the trigger event, such that the panel can be in a more power-saving mode.

Figure 2:
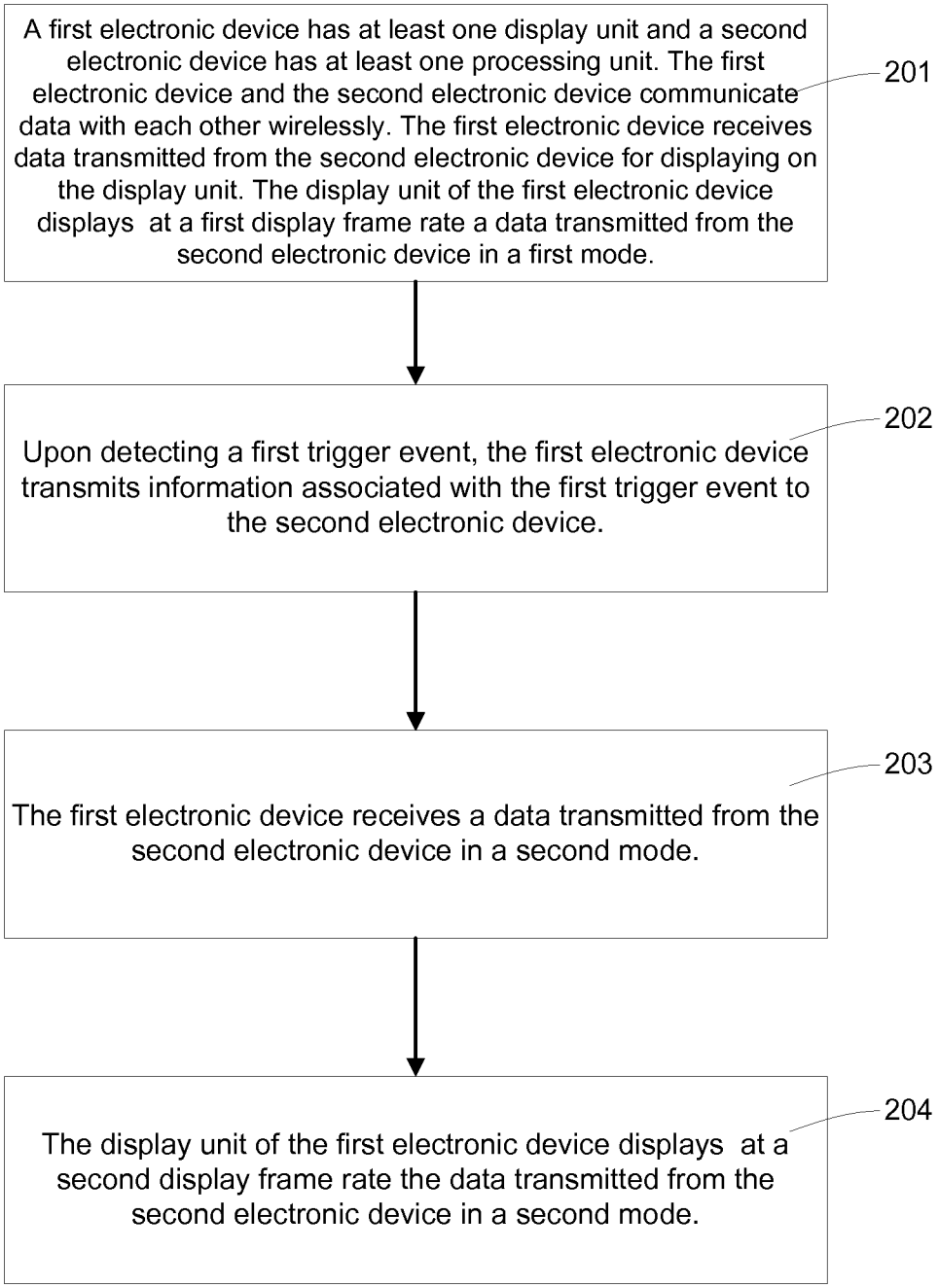
FIG. 2 is a flowchart illustrating a data transmission method according to an embodiment of the present invention.

According to an embodiment of the present invention, a data transmission method is provided. As shown in FIG. 2, the method may be applied in two electronic devices, of which a first electronic device has at least one display unit and a second electronic device has at least one processing unit. The first electronic device and a second electronic device communicate data with each other wirelessly. The first electronic device receives data transmitted from the second electronic device for displaying on the display unit. The method may include the following steps.

At step 201, the display unit of the first electronic device displays at a first display frame rate, a data transmitted from the second electronic device in a first mode.

At step 202, upon detecting a first trigger event, the first electronic device transmits information associated with the first trigger event to the second electronic device.

At step 203, the first electronic device receives a data transmitted from the second electronic device in a second mode.

At step 204, the display unit of the first electronic device displays at a second display frame rate the data transmitted from the second electronic device in a second mode.

With the above solutions, the first electronic device supports both a first display frame rate and a second display frame rate. The second electronic device supports both a first mode corresponding to the first display frame rate and a second mode corresponding to the second display frame rate. Because these two electronic devices can be automatically switched between the two display frame rates and the two modes in response to the first trigger event, when one of the first and second display frame rates has lower power consumption than the other, the power consumptions of the first and second electronic devices can be reduced.

In a preferred embodiment, the first electronic device may be a panel and the second electronic device may be a host. The panel and the host are components of a split-type computer.

In a preferred embodiment, the first display frame rate is lower than the second display frame rate, compared with displaying the data at the second display frame rate, the display unit has a lower power consumption when displaying the data at the first display frame rate, and the second electronic device has a lower power consumption in the first mode than in the second mode.

Here, the first mode can be a sleep mode or an idle mode. The second mode can be another mode having higher power consumption than the first mode, e.g., it may be a document editing mode, a high definition audio/video playing mode, a game mode, or the like.

In a preferred embodiment, the second electronic device has a data transceiver unit. The data transceiver unit has a data transmission rate corresponding to the first display frame rate when the second electronic device is in the first mode. The data transceiver unit has a data transmission rate corresponding to the second display frame rate when the second electronic device is in the second mode.

Figure 3:
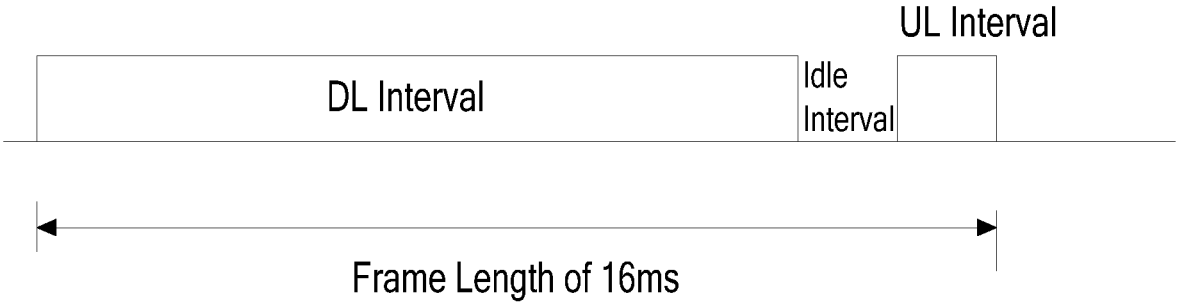
FIG. 3 is a schematic diagram showing a frame structure for data transmission according to an embodiment of the present invention.

In a preferred embodiment, as shown in FIG. 3, each frame has a frame length of 16 ms and comprises a downlink (DL) interval and an uplink (UL) interval. The downlink interval occupies 95% of the frame length and the uplink interval occupies at least 5% of the frame length. An idle interval can also be contained.

The downlink interval is used to transmit data wirelessly and the uplink interval is used to receive data. Here, the DL interval of the first electronic device corresponds to the UL interval of the second electronic device and the UL interval of the first electronic device corresponds to the DL interval of the second electronic device.

The first display frame rate is 16 fps or 15 fps and the second display frame rate is 64 fps or 60 fps.

In a preferred embodiment, the step in which the display unit of the first electronic device displays the data transmitted from the second electronic device in the first mode at the first display frame rate may include: configuring a predetermined number of frames as a period, each period containing preferably four frames; reserving the downlink interval and the uplink interval in the first frame of the period and reserving only the uplink interval in the remaining frames of the period, or reserving the downlink interval and the uplink interval in the first frame of the period without reserving the downlink interval or the uplink interval in the remaining frames of the period.

When the panel is used, it supports various usage modes and corresponding scenarios, including:

1. The panel is in an idle state, corresponding to an idle mode.

2. The panel is used for displaying a desktop or browsing a webpage, in which case images are changed at a low frame rate, corresponding to a browsing mode.

3. The panel is used for editing a document, corresponding to a document editing mode.

4. The panel is used in a scenario for browsing an image, corresponding to an image mode.

5. The panel is used for playing a high definition movie or playing a real-time game, corresponding to a high definition mode or a game mode.

6. The panel is used in an interactive scenario such as touch control, corresponding to a touch mode.

Here, in the usage modes such as a high definition mode, a game mode or a touch mode, a high frame rate of 60 fps (frames per second) is required for updating images. In the usage modes corresponding to the other application scenarios, it is shown by experiments that a low frame rate of about 12 fps will be sufficient. Hence, during the usage process, it is required to configure the frame transmission rate depending on the usage scenarios, so as to reduce the power consumption of the panel.

In a preferred embodiment, the first trigger event is a touch operation.

In a preferred embodiment, the step in which the first electronic device transmits, upon detecting the first trigger event, the information associated with the first trigger event to the second electronic device may include: notifying, when the first trigger event occurs before the uplink interval of a current frame, the second electronic device within the uplink interval of the current frame; and notifying, when the first trigger event occurs during the uplink interval of the current frame, the second electronic device within the uplink interval of a next frame subsequent to the current frame.

In a certain application scenario, the first electronic device is a panel and the second electronic device is a host. The panel supports a first display frame rate and a second display frame rate. The host supports a first mode corresponding to the first display frame rate and a second mode corresponding to the second display frame rate. The method may include the following steps.

At step 1, the panel communicates with the host wirelessly. Herein, currently the panel is displaying a data transmitted from the host in the first mode at the first display frame rate. The first display frame rate is lower than the second display frame rate. Compared with displaying the data at the second display frame rate, the display unit of the panel has the lower power consumption when displaying the data at the first display frame rate. The second electronic device has the lower power consumption in the first mode than that in the second mode.

At step 2, the panel detects a first trigger event, which is in particular a touch operation. That is, there is a touch operation performed by a user on the panel and the touch operation is determined as valid by a detection unit of the panel.

At step 3, the panel is switched to the second display frame rate corresponding to the second mode.

At step 4, the panel transmits information associated with the touch operation to the host.

Here, the information associated with the touch operation can be transmitted using the frame structure shown in FIG. 3. The transmission process may follow the rules as described below.

Rule 1: when the touch operation occurs before the uplink interval of the current frame, the host will be notified within the uplink interval of the current frame.

Rule 2: when the touch operation occurs during the uplink interval of the current frame, the host will be notified within the uplink interval of a next frame subsequent to the current frame.

At step 5, the host receives from the panel the information associated with the touch operation and determines that the panel has been switched to the second display frame rate. Because the second display frame rate corresponds to the second mode, the host is automatically switched to the second mode.

At step 6, the host transmits a data to the panel in the second mode.

At step 7, the display unit of the panel displays the data transmitted from the host at the second display frame rate.

In a touch interaction scenario, the frame rate of the wireless transmission is controlled to reduce identical frames transmitted by a wireless module when there is no user operation and the display picture is idle.

It is also possible to detect the application scenario and apply a high frame transmission rate control in the scenarios such as audio/video or game scenarios. The detection mechanism can be achieved by the user manually configuring the mode or by a wireless display driver automatically.

In a preferred embodiment, the method further includes, subsequent to the step in which the display unit of the first electronic device displays at the first display frame rate the data transmitted from the second electronic device in the first mode: transmitting, by the second electronic device upon detecting a second trigger event, information associated with the second trigger event to the first electronic device; receiving, by the second electronic device, data transmitted from the first electronic device in the second mode; and processing, by the processing unit of the second electronic device, the data transmitted from the first electronic device in the second mode.

In a preferred embodiment, the second trigger event includes at least one of a key pressing operation, a stream media play, a game event, a quick view of an image and a document operation.

In an application scenario, the first electronic device is a panel and the second electronic device is a host. The panel supports both a first display frame rate and a second display frame rate. The host supports both a first mode corresponding to the first display frame rate and a second mode corresponding to the second display frame rate. The method may include the following steps.

At step 1, the panel communicates with the host wirelessly. Here, the panel displays at the first display frame rate a data transmitted from the host in the first mode. The first display frame rate is lower than the second display frame rate. Compared with displaying the data at the second display frame rate, the display unit of the panel has a lower power consumption when displaying the data at the first display frame rate. The host has the lower power consumption in the first mode than that in the second mode.

At step 2, the host detects a second trigger event, which can be any of a key pressing operation, a stream media play, a game event, a quick view of an image and a document operation. That is, there is an action of pressing a key, playing an audio/video file, entering a game interface, browsing an image or editing a document on the host and the operation is determined by the host as valid.

At step 3, the host is switched to the second mode corresponding to the second display frame rate of the panel.

At step 4, the host transmits information associated with the second trigger event to the panel.

Here, the host can transmit the information associated with the second trigger event in the frame structure shown in FIG. 3. The transmission process may follow the rules as described below.

Rule 1: when the second trigger event occurs before the uplink interval of the current frame, the panel will be notified within the uplink interval of the current frame.

Rule 2: when the second trigger event occurs during the uplink interval of the current frame, the panel will be notified within the uplink interval of a next frame subsequent to the current frame.

At step 5, the panel receives from the host the information associated with the second trigger event and determines that the host has been switched to the second mode. Because the second mode corresponds to the second display frame rate, the panel is automatically switched to the second display frame rate.

At step 6, the panel receives a data transmitted from the host in the second mode.

At step 7, the display unit of the panel displays the data transmitted from the host at the second display frame rate.

Figure 4:
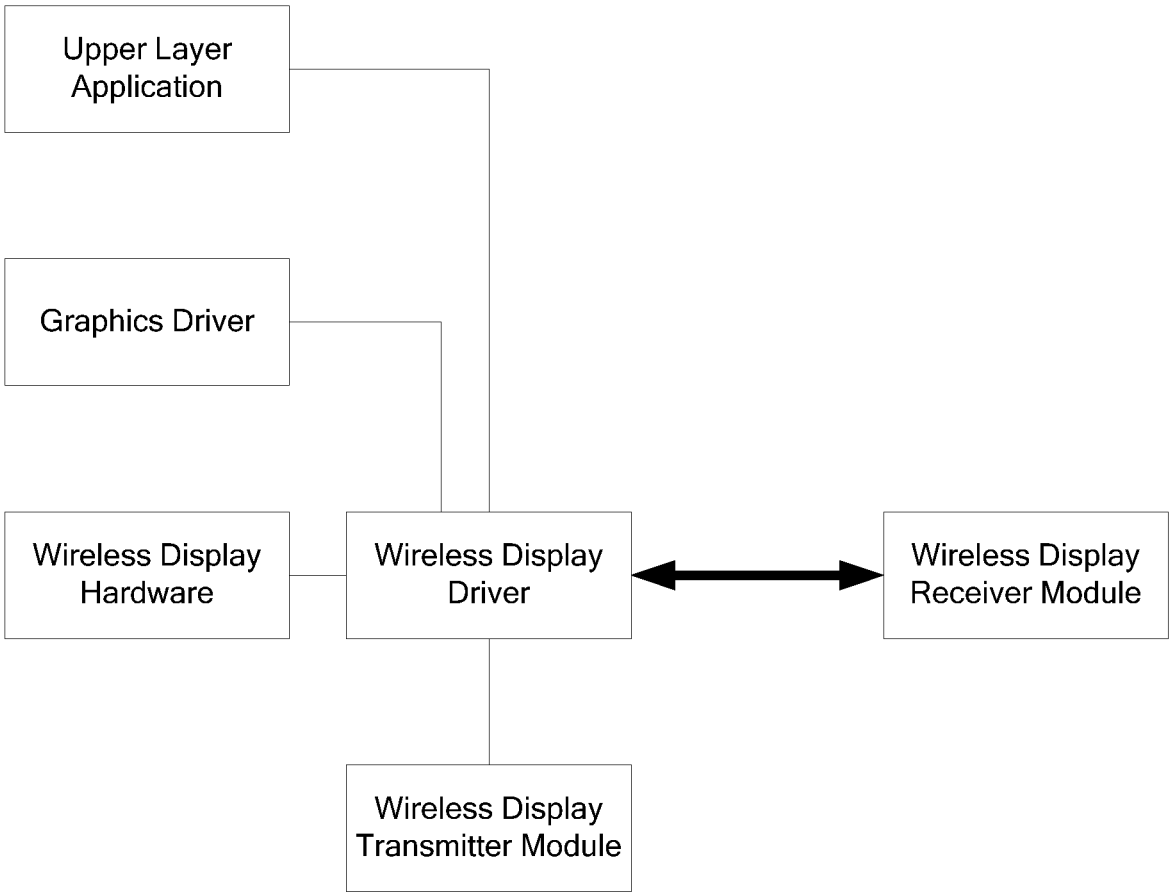
FIG. 4 is a schematic diagram showing a flow of signal within an electronic device according to an embodiment of the present invention.

In a preferred embodiment, in order to facilitate the understanding of the solutions according to the various embodiments, an implementation based on a common split-type computer will be described below. As shown in FIG. 4, a wireless display driver is incorporated in a host of a split-type computer. The wireless display driver provides at least the following four functions.

Downlink Command API, which receives commands from an upper layer wireless application (e.g., an audio/video player), graphics driver or wireless display hardware.

Downlink Command, which is a configuration command for lower layer wireless display transmitter hardware (the wireless display driver configures the wireless display transmission and reception functions in response to an invocation from the downlink command API).

Uplink Interrupt API, which notifies an upper layer wireless application, graphics driver or reports state information of a wireless display terminal (e.g., a trigger event), such that the upper layer wireless application can determine whether to transmit a display content based on the state of the panel. In other words, an interrupt mechanism is initiated in response to a trigger event to switch from the current periodical transmission of the display picture to a data transmission between the host and the panel as controlled by the trigger event.

Uplink Interrupt, which is a lower layer interrupt request. The wireless display driver sends a report to the upper layer application based on the type and definition of the interrupt and invokes the uplink interrupt API.

In a specific application scenario, the usage mode can be a document editing mode (e.g., Office Mode). Among the respective units and modules in the host, the graphics driver determines that the current usage mode is the document editing mode based on the usage mode of the panel and a display data updating rate (DPST), and the graphics driver invokes the wireless display driver via the downlink command API and notifies the wireless display transmitter hardware that the current usage mode is the document editing mode.

Figure 5:
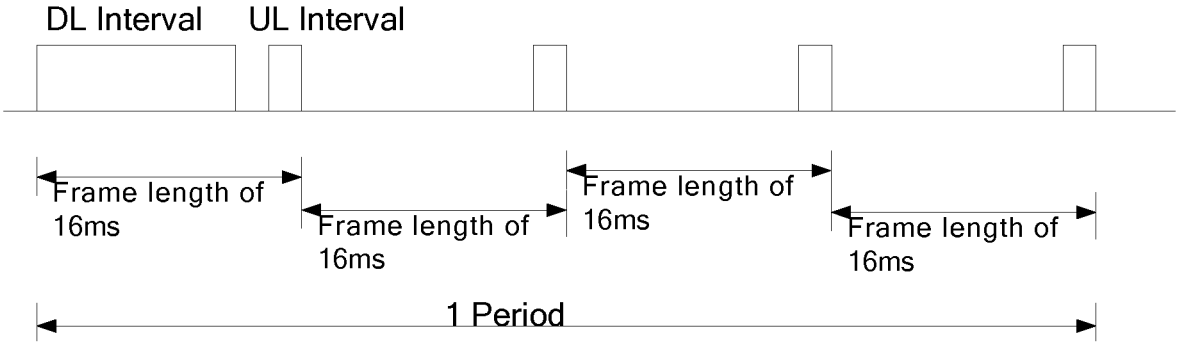
FIG. 5 is a schematic diagram showing a frame transmitted in a document editing mode according to an embodiment of the present invention.

As shown in FIG. 5, the wireless display driver of the host reduces the current frame transmission rate of 60 fps to 15 fps in response to a command from the downlink command API. That is, four frames constitute a period. Each period contains four frames, with three blank frames inserted therein (three frames are not transmitted).

In each of the three inserted blank frames, it is detected whether there is an uplink interrupt or not. If not, the next blank frame will be transmitted continuously.

At the end of the blank frame detection, if an uplink interrupt (an uplink interrupt triggered by a trigger event) is detected, the graphics driver and the upper layer application will be notified immediately to transmit a frame image corresponding to the current display content.

The wireless display transmitter hardware transmits the next frame.

In a specific application scenario where the usage mode is a high definition move playing mode (Movie mode) or a real-time game mode (Game mode) and the second mode is the Movie mode, the operational principles of the respective units and modules in the host are as follows.

The wireless display transmitter hardware is initiated and the wireless display driver is loaded.

The wireless display driver invokes an API for detecting whether the current application is associated with the Movie mode or the Game mode.

The wireless display driver configures the wireless display transmitter hardware into the Movie mode which supports 60 fps.

The wireless display driver controls the wireless display transmitter hardware to transmit frames at 60 fps in the Movie mode.

With the solution according to the above embodiment, the overall power consumption of the panel over a time length of 1 second is assumed to be W and the power consumption of the wireless display transmitter hardware occupies 80% of the overall power consumption of the panel, i.e., 0.8 W. In the example where one period contains four frames, only one out of the four frames is used in one period and the remaining frames are unused or only the UL interval of each of the remaining frames is used. Without loss of generality, it is assumed that the DL interval occupies 95% of a frame, the UL period occupies up to 5% of a frame, and the display frame rate corresponding to the second mode is 64 fps.

1. When only one frame is used and only the UL interval of each of the remaining three frames is used, in the second mode, the power consumption of each frame is P=0.8164.

When it is switched to the first mode, the power consumption of the first frame is still P and the power consumption of each of the second to the fourth frames is P*5%*3.

The power consumption within 1 second is 16 P+16*(P*5%*3).

The power consumption is reduced by 0.8 W−(16 P+16*(P*5%*3)).

2. When only one frame is used and the remaining three frames are unused, in the second mode, the power consumption of each frame is P=0.8164.

When it is switched to the first mode, the power consumption of the first frame is still P and the power consumption of each of the second to the fourth frames is 0.

The power consumption within 1 second is 16 P.

The power consumption is reduced by 0.8 W-16 P.

It can be seen from the above calculations that, with the solution according to the above embodiment of the present invention, when one of the first and second display frame rates has the lower power consumption than the other, the power consumptions of the first and second electronic devices can be reduced.

Figure 6:
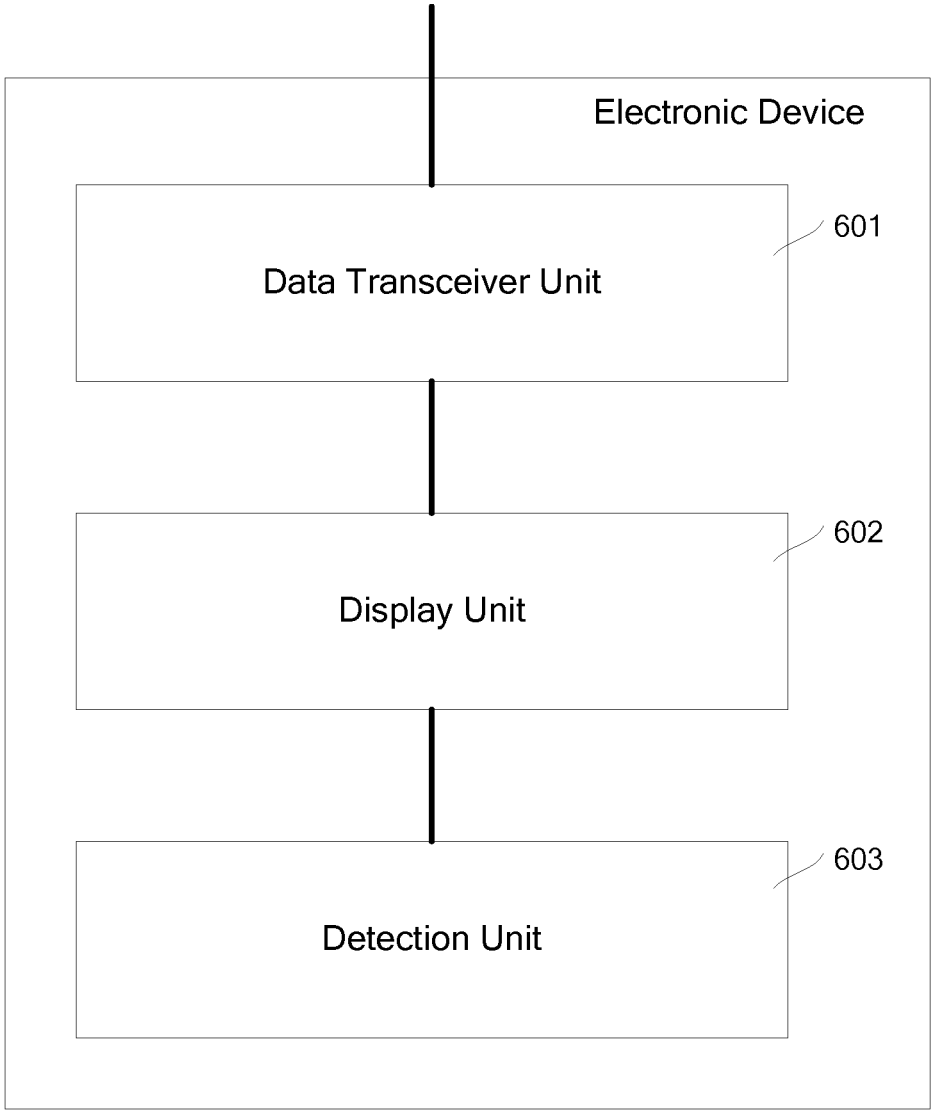
FIG. 6 is a schematic diagram showing a structure of an electronic device according to an embodiment of the present invention.

According to an embodiment of the present invention, an electronic device is provided. As shown in FIG. 6, the electronic device may include the following units.

A data transceiver unit 601 is configured to communicate data with a second electronic device wirelessly and receive data transmitted from the second electronic device.

A display unit 602 is configured to display the data transmitted from the second electronic device in the first mode at a first display frame rate.

A detection unit 603 is configured to transmit, upon detecting a first trigger event, information associated with the first trigger event to the second electronic device.

Here, the data transceiver unit 601 is further configured to receive data transmitted from the second electronic device in a second mode. The display unit 602 is further configured to display the data transmitted from the second electronic device in the second mode at a second display frame rate.

With the above solution, the first electronic device supports a first display frame rate and a second display frame rate. The second electronic device supports a first mode corresponding to the first display frame rate and a second mode corresponding to the second display frame rate. Because these two electronic devices can be automatically switched between the two display frame rates and the two modes in response to the first trigger event, when one of the first and second display frame rates has a lower power consumption than the other, the power consumptions of the first and second electronic devices can be reduced.

In a preferred embodiment, the first electronic device is a panel and the second electronic device is a host. The panel and the host are components of a split-type computer.

In a preferred embodiment, the first display frame rate is lower than the second display frame rate, the display unit has a lower power consumption when displaying the data at the first display frame rate than when displaying the data at the second display frame rate, and the second electronic device has a lower power consumption in the first mode than in the second mode.

Here, the first mode can be a sleep mode or an idle mode. The second mode can be another mode having the higher power consumption than the first mode, e.g., it can be a document editing mode, a high definition audio/video playing mode, a game mode, or the like.

In a preferred embodiment, the electronic device further includes: a frame configuration unit configured to notify, when the first trigger event occurs before an uplink interval of a current frame, the second electronic device within the uplink interval of the current frame; and notifying, when the first trigger event occurs during the uplink interval of the current frame, the second electronic device within the uplink interval of a next frame subsequent to the current frame. Each frame has a frame length of 16 ms and contains a downlink interval and an uplink interval.

The electronic device may include a host, a panel and an input unit. The host, which serves as a wireless display transmitter, includes a host module, a baseband module, a wireless display transmitter module and a memory module (e.g., SDRAM). The host module includes a CPU and a GPU.

Here, the interface between the host module and the baseband module can be DVO or HDMI, DP or PCIE.

The host module decodes an audio/video file or transmits an audio/video file directly to the wireless display transmitter module.

The baseband module is a core device of the host and includes a wireless network MAC layer, an encoder, a modulation interface and a radio frequency integrated circuit (RFIC).

The wireless network MAC layer encapsulates the audio/video file transmitted from the host module into packets or processes raw data, and deals with the communication of a wireless network protocol with a wireless receiver.

The modulation interface modulates the encoded audio/video file packets into a particular format and transmits them to the RFIC for transmission wirelessly.

The RFIC may include two independent RF chips or a chip having independent channels. It may include functional modules, such as a radio frequency power amplifier (RF PA) and an uplink/downlink channel management module, for supporting the following channels: an uplink channel, which is typically a data transmission channel, and a downlink channel, which is a control/reverse transmission channel.

The memory module provides a memory space for baseband data to be processed.

With the embodiments of the present invention, the existing mechanism based on fixed frame transmission rate can be adapted to a different frame transmission mechanism triggered by a trigger event. The first electronic device supports both a first display frame rate and a second display frame rate. The second electronic device supports both a first mode corresponding to the first display frame rate and a second mode corresponding to the second display frame rate. These two electronic devices allow manual configuration or automatic recognition of application scenarios, such that the effective frame rate of the wireless display transmission can be dynamically controlled to achieve an optimum power adjustment for DL/UL. When one of the first and second display frame rates has the lower power consumption than the other, the power consumptions of the first and second electronic devices can be reduced.

While the preferred embodiments of the present invention have been described above, various modifications and improvements can be made by those skilled in the art without departing from the principle of the present invention. These modifications and improvements are to be encompassed by the scope of the present invention.

What is claimed is:

1. A data transmission method applied in a split-type computer, wherein the split-type computer comprises at least one display unit and at least one processing unit, wherein the display unit and the processing unit communicate data with each other wirelessly, wherein the display unit receives data transmitted from the processing unit for displaying, the method comprising:

displaying at a first display frame rate, by the display unit, data transmitted wirelessly from the processing unit in a first mode corresponding to the first display frame rate;

detecting, by the display unit, a first trigger event;

initiating, upon detecting the first trigger event, by the display unit, an interrupt mechanism in response to the first trigger event, wherein the interrupt mechanism switches from a current periodical transmission of the data to be displayed to a data transmission between the display unit and the processing unit as controlled by the first trigger event so as to transmit information associated with the first trigger event to the processing unit;

switching from the first display frame rate to a second display frame rate, by the display unit, in response to the interrupt mechanism;

transmitting, by the display unit, information associated with the first trigger event to the processing unit;

transmitting, by the processing unit, data to the display unit in a second mode corresponding to the second display frame rate, in response to the information associated with the first trigger event; and displaying at the second display frame rate, by the display unit, the data transmitted wirelessly from the processing unit in the second mode, wherein each frame of the data transmitted from the processing unit has a frame length of 16 ms and comprises a downlink interval and an uplink interval, and wherein the downlink interval occupies 95% of the frame length and the uplink interval occupies at least 5% of the frame length.

2. The method of claim 1, wherein the first display frame rate is lower than the second display frame rate, compared with displaying the data at the second display frame rate, the display unit has a lower power consumption when displaying the data at the first display frame rate, and the processing unit has a lower power consumption in the first mode than in the second mode.

3. The method of claim 1, wherein the processing unit has a data transceiver unit, and the data transceiver unit has a data transmission rate corresponding to the first display frame rate when the processing unit is in the first mode, and the data transceiver unit has a data transmission rate corresponding to the second display frame rate when the processing unit is in the second mode.

4. The method of claim 1, wherein said transmitting upon detecting the first trigger event, the information, by the display unit associated with the first trigger event to the processing unit comprises:

notifying, when the first trigger event occurs before the uplink interval of a current frame, the processing unit within the uplink interval of the current frame; and notifying, when the first trigger event occurs during the uplink interval of the current frame, the processing unit within the uplink interval of a next frame subsequent to the current frame.

5. The method of claim 1, wherein the first trigger event comprises a touch operation.

6. The method of claim 1, wherein, the first display frame rate is 16 fps or 15 fps and the second display frame rate is 64 fps or 60 fps.

7. The method of claim 6, wherein said displaying at the first display frame rate, by the display unit, the data transmitted from the processing unit in the first mode comprises:

configuring a predetermined number of frames as a period, each period containing four frames;

reserving the downlink interval and the uplink interval in the first frame of the period and reserving only the uplink interval in the remaining frames of the period, or reserving the downlink interval and the uplink interval in the first frame of the period without reserving the downlink interval or the uplink interval in the remaining frames of the period.

8. The method of claim 1, further comprising, subsequent to said displaying at the first display frame rate, by the display unit, the data transmitted from the processing unit in the first mode:

transmitting upon detecting a second trigger event, by the processing unit, information associated with the second trigger event to the display unit;

receiving, by the processing unit, data transmitted from the display unit in the second mode; and processing, by the processing unit of the processing unit, the data transmitted from the display unit in the second mode.

9. The method of claim 8, wherein the second trigger event comprises at least one of a key pressing operation, a stream media play, a game event, a quick view of an image and a document operation.

10. An electronic device, configured to be a component of a split computer, wherein the split computer also comprises a host, the electronic device comprise:

a data transceiver that communicates data with the host wirelessly, receives data transmitted from the host in a first mode corresponding to a first display frame rate and receives data transmitted from the host in a second mode corresponding to a second display frame rate;

a display that displays at the first display frame rate the data transmitted wirelessly from the host in the first mode and displays at the second display frame rate the data transmitted from the host in the second mode; and a detector that detects a first trigger event, and initiates, upon detecting the first trigger event, an interrupt mechanism in response to the first trigger event, wherein the interrupt mechanism switches from a current periodical transmission of the data to be displayed to a data transmission between the display unit and the host as controlled by the trigger event to transmit information associated with the first trigger event to the host, wherein the data transceiver further transmits information associated with the first trigger event to the host;

wherein the display further switches from the first display frame rate to the second display frame rate in response to the interrupt mechanism and displays, at the second display frame rate, the data transmitted wirelessly from the host in the second mode in response to the information associated with the first trigger event, wherein each frame of the data transmitted from the host has a frame length of 16 ms and comprises a downlink interval and an uplink interval, and wherein the downlink interval occupies 95% of the frame length and the uplink interval occupies at least 5% of the frame length.

11. The electronic device of claim 10, wherein the first display frame rate is lower than the second display frame rate, compared with displaying the data at the second display frame rate, the display unit has a lower power consumption when displaying the data at the first display frame rate, and the host has a lower power consumption in the first mode than that in the second mode.

12. The electronic device of claim 10, further comprising:

a frame configurator that notifies, when the first trigger event occurs before the uplink interval of a current frame, the host within the uplink interval of the current frame; and wherein the frame configurator further notifies, when the first trigger event occurs during the uplink interval of the current frame, the host within the uplink interval of a next frame subsequent to the current frame.

* * * * *